United States Patent [19]

Yamazaki et al.

[11] 4,116,487

[45] Sep. 26, 1978

[54] DEVICE FOR REMOVING GRAVELS AND THE LIKE FROM DISCHARGED MUD IN HYDRAULIC TUNNEL BORING SYSTEM

[75] Inventors: Hironobu Yamazaki, Kashiwa; Yoshiaki Uchida, Koshigaya; Akira Nakaya, Tokyo, all of Japan

[73] Assignee: Tekken Construction Co. Ltd., Tokyo, Japan

[21] Appl. No.: 762,106

[22] Filed: Jan. 24, 1977

[30] Foreign Application Priority Data

Mar. 8, 1976 [JP] Japan ..... 51-24074

[51] Int. Cl.[2] ..... E21D 9/08; E21C 39/00

[52] U.S. Cl. ..... 299/1; 299/8; 299/18; 299/64; 405/141

[58] Field of Search ..... 299/1, 18, 64, 7–9; 61/84, 85; 175/66, 62, 206

[56] References Cited

U.S. PATENT DOCUMENTS

| | | | |
|---|---|---|---|
| 360,959 | 4/1887 | Greathead | 175/62 X |
| 3,334,945 | 8/1967 | Bartlett | 299/33 |
| 3,350,889 | 11/1967 | Sturm | 299/33 X |
| 3,830,545 | 8/1974 | Sugden | 61/85 X |

*Primary Examiner*—Ernest R. Purser

*Attorney, Agent, or Firm*—Burns, Doane, Swecker & Mathis

[57] ABSTRACT

A device for removing relatively larger size gravels, stones, crushed rocks and the like contained in a discharged mixture of fed slurry or muddy water and excavated ground formation components in hydraulic tunnel boring systems. The device comprises a lattice-shaped classifying means connected at one end to a discharging pipe for conducting the mixture from the tunnel face, a primary chamber connected to the other end of the classifying means for receiving and storing classified gravels and the like, and a secondary chamber communicating with the primary chamber through a valve for receiving and retaining the gravels and the like filled in the primary chamber. A housing surrounds and rotatably supports the classifying means and includes a discharging pipe for conducting muddy water passed through the clarifying means. A motor rotates the classifying means for performing classifying work. The secondary chamber has a valve on its discharging side and the valve between the primary and secondary chambers and the valve of the secondary chamber are alternately closed and opened so that removal of the classified gravels and the like may be made without interrupting the hydraulic tunnel boring. The device is preferably provided at the discharging position of the secondary chamber for weighing classified and discharged gravels and the like for determining actually excavated amount of the ground formation components in cooperation with means for determining dry mud amount provided in feeding and discharging pipes of the slurry or water and the mixture.

3 Claims, 3 Drawing Figures

PRIOR ART

DEVICE FOR REMOVING GRAVELS AND THE LIKE FROM DISCHARGED MUD IN HYDRAULIC TUNNEL BORING SYSTEM

This invention relates to a gravel removing device for a discharging system in hydraulic tunnel boring systems and, more particularly, to improvements in devices for removing relatively larger size gravels, stones and the like contained in hydraulically excavated mud in the course of discharging the mud out of tunnels being bored.

In boring tunnels with a slurry or muddy water fed through a feeding system to a tunnel face end of a shield type tunnel boring machine while discharging excavated mud together with the fed water through a discharging system out of the tunnels, any gravels, stones, crushed rocks and the like of relatively larger sizes (which shall be referred to hereinafter "gravels" for simplicity) contained in the mud are likely to cause the discharging system to be clogged and interrupt smooth flow of the mud and water. In order to keep the flow smooth, therefore, certain measures of removing such gravels out of the mud to be discharged have already been suggested and developed.

While one of such measures is to typically provide a trommel in the discharging system, it has been also suggested to carry the discharged mud and water in bulk employing a large container as disclosed, for example, in Japanese Laid-Open Patent Application No. 52424/1974 as shown herein in FIG. 3. In that proposal a conveyer 101 for discharging excavated mud is connected with the lower part of a partition wall of a shield type excavator 102, and a valve 103 is provided in a discharging port 104 of the conveyer. The valve is opened after an inlet port 105*a* of a pressure container 105, attached to a carriage 106, is connected to an outlet end of the valve so that all the excavated mud together with the fed water will be fed into the pressure container 105 under a pressure.

According to this measure, however, the valve 103 is closed when the pressure container 105 is filled with the mud and water, so that the container 105 may be moved by the carriage 106, and the boring operation must be stopped until the container 105, after emptied is again connected to the conveyer. Therefore, there have been defects in that the boring operation is not continuous and that the slurry or muddy water at the tunnel face becomes hard to be kept constant in its quality since its circulation must be often interrupted. The present invention has been suggested to improve the tunnel boring system of the kind referred to in respect of such defects as noted above.

A primary object of the present invention is to provide a gravel removing device for a discharging system wherein the gravels can be removed without interrupting the tunnel boring operation.

A further object of the present invention is to provide a gravel removing device which enables the hydraulic tunnel boring operation to be successively performed depending on an accurate excavated amount determined by measuring the amount of gravels removed by a gravel discharging device.

Yet another object of the present invention is to uniformly control the quality of a slurry or muddy water to be fed to a hydraulic chamber of a shield type tunnel boring machine.

Other objects and advantages of the present invention shall become clear from the following explanation of the invention as detailed with reference to certain preferred embodiments illustrated in accompanying drawings, in which.

Figure 1:
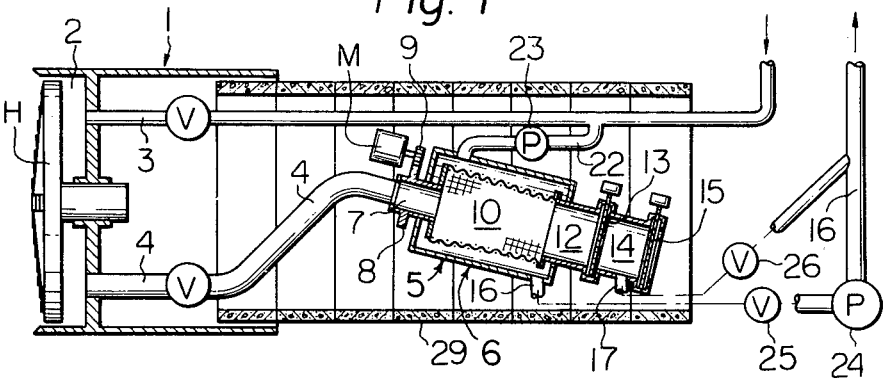
FIG. 1 is a schematic sectioned view of a hydraulic tunnel boring system using a shield type excavating machine including an exemplary gravel removing device.

Referring to FIG. 1, a rotary ground cutter head H is provided at the front face of a cylindrical shield type excavating or boring machine 1 so as to be rotated by a motor or other any suitable driving means (not shown). A hydraulic chamber 2 is formed in the front part of the machine 1 behind the cutter head H as partitioned from inner space of the machine. A feeding pipe 3 communicates with the chamber 2 for feeding a slurry or muddy water (which shall be referred to hereinafter simply "water") into the hydraulic chamber 2 for hydraulically boring a tunnel in the ground. A discharging pipe 4 communicates with the chamber 2 for discharging excavated mud together with the fed water from the chamber 2 to the outside of the tunnel being bored. A gravel removing device 5 fluidly communicates with the discharging pipe 4 for removing or separating any gravels contained in the excavated and discharged mud. The device comprises a hollow cylindrical housing 6, and a cylindrical body 7 provided inside the housing and is rotatably mounted at one end to the body substantially in coaxial relation thereto. A trommel 10 is connected at one axial end to the body 7 inside the housing and is also rotatably therewith. A primary gravel storing chamber 12 and a secondary gravel retaining chamber 14 respectively sequentially communicate with the other end of the trommel and are disposed outside the housing 6. The cylindrical body 7 is provided with a gear 8 in mesh with a driving gear 9 of a motor M so that the cylinder body 7 and trommel 10 will be rotated by the motor M. To the cylindrical body 7, the discharging pipe is connected so that a mixture of the fed water and excavated mud will be supplied into the tommel 10. This trommel 10 is made of a screen cylinder or lattice-shaped classifier. Between the gravel storing chamber 12 and the gravel retaining chamber 14, there is provided a ball valve or opening and closing valve 13, while the gravel retaining chamber 14 is provided at exterior end with an opening and closing valve 15. Discharging pipes 16 and 17 are provided respectively on the lower surfaces of the housing 6 and secondary gravel retaining chamber 14, which pipes are provided respectively with valves 25 and 26 and are joined together so as to discharge respective muddy water flowing out of the housing 6 and chamber 14 to a location outside the tunnel being bored. A pump 24 is provided preferably in the discharging pipe 16 so as to urge the discharging flow under a pressure. A water conduit pipe 22 connects between the water feeding pipe 3 and the housing 6 directly and this pipe is preferably provided with a pump 23, so that the classifying and discharging flow may be accelerated as required. The device 5 is normally positioned in tunnel wall segments 29 installed behind the propelled machine 1, and its inlet side on which the device is connected with the discharging pipe 4 is higher than the other side connected to the gravel storing and retaining chambers 12 and 14, so that the mixture of the fed water, excavated mud and gravels and the like gravitate through the device.

Working operation of the system using the device of the present invention shall be explained in the following.

When a slurry or muddy water is fed through the feeding pipe 3 while rotating the cutter head H, the mixture of excavated mud including any gravels will be conducted through the discharging pipe 4 so as to enter the classifier 10 through the rotating cylindrical body 7 and will be separated there into the gravels and smaller mud components and the mixture thus classified will be discharged out through the discharging pipes 16 and 17 and also the valves 25 and 26 opened under urgings of the pump 24. The gravels remaining in the classifier 10 will be carried to the gravel storing chamber 12. Now, when the valves 13 and 15 and the valve 26 of the water discharging pipe 17 are opened and closed alternatively by a proper controlling device or manually, the gravels in the storing chamber 12 will gravitate into the gravel retaining chamber 14. Then the valve 13 is closed and the valves 15 and 26 are opened, so that the gravels in the gravel retaining chamber 14 may be discharged out of the chamber for further conveyance while still existing muddy water is discharged to the discharging pipe 17. If, as required, the thus discharged gravels out of the chamber 14 are weighed with a scale, their weight will be able to be known as will be described later.

According to the present invention, since the gravel storing chamber 12 and gravel retaining chamber 14 are provided downstream of the classifier or trommel 10 and are connected with each other through the valve 13 and the latter gravel retaining chamber 14 is provided with the valve 15, the gravels classified in the classifier 10 can be repetitively continuously caused to be discharged so that, with a single gravel removing device, the discharging flow through the discharging pipe 4 can be continued, without interruption of the boring operation. Also, the flow through the discharging pipe is not likely to be clogged. Further, the gravels discharged out of the gravel retaining chamber 14 can be automatically weighed and an electric signal representing the weighed value can be utilized for an automatic control of the boring system.

Figure 2:
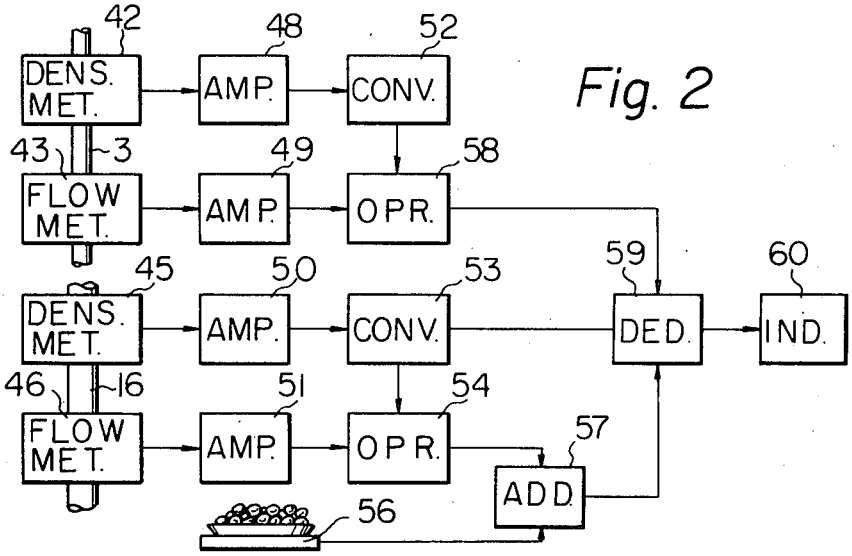
FIG. 2 is a block diagram showing an example of a system for measuring actually excavated mud amount, which is employed in the hydraulic tunnel boring system in combination with the gravel removing device according to the present invention.
Figure 3:
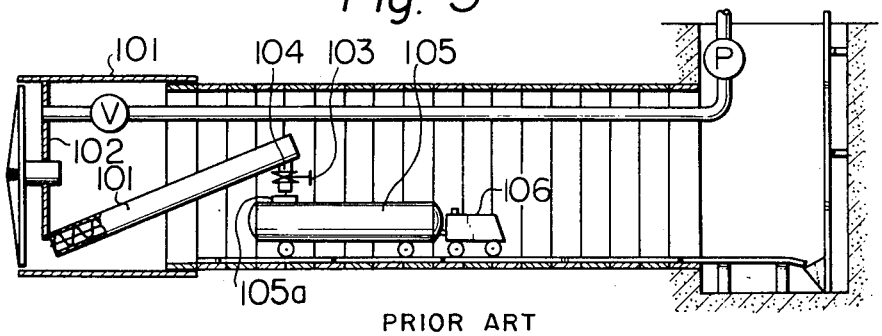
FIG. 3 is a schematic sectioned view of a conventional tunnel boring system.

In FIG. 2, there is shown an example of an actually excavated mud weighing method using the device of the present invention. In the diagram, the slurry or muddy water feeding pipe 3 is provided with a $\gamma$-ray densimeter 42 and electromagnetic flow meter 43, and the mixture discharging pipe 16 is also provided with a $\gamma$-ray densimeter 45 and electromagnetic flow meter 46. A signal from the $\gamma$-ray densimeter 45 is amplified by an amplifier 50, the amplified signal being converted to a direct current signal and is converted to be of the flowing value by a ratio converter 53 according to a formula:

$$\frac{(\gamma - 1)}{(\gamma_0 - 1)} \times \gamma_0$$

where $\gamma$ is a value measured with said densimeter 45 and $\gamma_o$ is a value of the real specific gravity of a ground layer on the spot obtained by a test excavation made in advance. On the other hand, an electric signal obtained from the electromagnetic flow meter 46 is amplified by an amplifier 51, which is converted to a direct current signal and presented to an operator 54. In the operator 54, a product of signals from the devices 51 and 53 is determined so that an amount $G_2$ of only dry mud in the discharging pipe 16 will be determined. Further, gravels discharged out of the gravel retaining chamber 14 are weighed with a scale 56 and an amount $G_3$ of the dry gravels shown by the weighed value and the amount $G_2$ of dry mud are added together with an adding machine 57. Further, an amount $G_1$ of dry mud in the feeding pipe 3 is determined with an operator 58 from the $\gamma$-ray densimeter 42 and flow meter 43 provided in the feeding pipe 3, an amount of discharged dry mud actually excavated is determined by $G_2 + G_3 - G_1$ with a deducting machine 59 and they are indicated with an indicating means 60. If this method is used, the operation will be able to be carried out while accurately weighing the amount excavated mud discharged in the tunnel boring operation and the operation can be efficiently performed under a proper control of the boring system depending on the weighed value.

What is claimed is:

1. In a hydraulic tunnel boring system in which pressurized water is fed to a hydraulic chamber at a boring head of a shield type tunnel boring machine through a feeding pipe for excavating ground formation, and excavated mud is discharged together with said water out of a tunnel being bored through a discharging pipe, a device for removing gravels, stones, rocks and the like of relatively larger sizes out of said excavated mud to be discharged, which comprises a rotatably mounted classifying means connected to said discharging pipe, said classifying means being of a lattice-shape, a housing surrounding said classifying means for rotatably retaining the classifying means and receiving the water and mud passed through the classifying means, a primary chamber communicating with a discharging side of the classifying means for receiving and storing separated gravels and the like of the relatively larger sizes from the classifying means, a secondary chamber communicating with said primary chamber for receiving and retaining such gravels and the like from the primary chamber, a primary valve means provided between said primary and secondary chambers for permitting removal of the gravels from the primary chamber to the secondary chamber when the primary chamber is filled with such gravels and the like, and a secondary valve means provided at a discharging side of the secondary chamber for permitting discharge of the gravels and the like when the secondary chamber is filled with the gravels and the like received from said primary chamber.

2. A gravel removing device according to claim 1 wherein said housing is a substantially cylindrical body disposed with its axis inclined relative to horizontal, said classifying means is also a substantially cylindrical body rotatably supported in said cylindrical housing substantially coaxially therewith, said classifying body communicating at one end with discharging pipe at a higher axial level of the housing, the other end of the classifying means supported rotatably at a lower level of said housing by said primary gravel storing chamber, and the cylindrical housing provided with a discharging pipe for said water and mud passed through the classifying means.

3. A gravel removing device according to claim 1 wherein said secondary gravel retaining chamber is provided with a discharging pipe including a valve for conducting a mixture of said water and mud which is carried to the chamber together with said gravels and the like, and means for weighing the gravels and the like discharged from said secondary chamber.

* * * * *